United States Patent [19]

Meinershagen

[11] Patent Number: 4,880,038

[45] Date of Patent: Nov. 14, 1989

[54] WIRE TWISTING APPARATUS

[75] Inventor: Charles I. Meinershagen, Redding, Calif.

[73] Assignee: NewTech Products, Inc., Palo Cedro, Calif.

[21] Appl. No.: 146,464

[22] Filed: Jan. 21, 1988

[51] Int. Cl.[4] ..... B21F 7/00; B21F 15/04

[52] U.S. Cl. ..... 140/93.6; 140/119

[58] Field of Search ..... 140/104, 115, 116, 118, 140/119, 120, 122, 149, 114, 93.6

[56] References Cited

U.S. PATENT DOCUMENTS

| | | | |
|---|---|---|---|
| 1,101,165 | 6/1914 | Champ | 140/121 |
| 1,209,434 | 12/1916 | Hayden | 140/119 |
| 1,472,763 | 10/1923 | Pomeroy | 140/119 |
| 1,498,616 | 6/1924 | Foulder | 140/119 |
| 2,289,253 | 7/1942 | Dowd | 140/119 |
| 2,394,807 | 5/1944 | Robinson | 7/4 |
| 2,772,702 | 12/1956 | Guignard | 140/119 |
| 2,964,069 | 4/1956 | Chappel et al. | 140/119 |
| 3,092,152 | 4/1961 | Neff | 140/119 |
| 3,131,731 | 1/1962 | Gulemi | 140/117 |
| 3,211,188 | 6/1962 | Wallshein | 140/120 |
| 3,310,076 | 3/1965 | Lawrow | 140/119 |
| 3,590,391 | 7/1971 | Winegar | 140/119 |
| 3,759,302 | 9/1973 | Attenborough | 140/119 |
| 3,786,841 | 10/1972 | Albrecht et al. | 140/119 |
| 3,844,322 | 10/1974 | Stoutenberg | 145/75 |
| 4,039,013 | 8/1977 | Stoutenberg | 145/53 |
| 4,160,469 | 7/1979 | Joannic | 140/115 |
| 4,448,225 | 5/1984 | Schmidt | 140/119 |

FOREIGN PATENT DOCUMENTS

| | | | |
|---|---|---|---|
| 111471 | 7/1964 | Czechoslovakia | 140/115 |
| 1140126 | 11/1962 | Fed. Rep. of Germany | 140/119 |
| 755729 | 8/1956 | United Kingdom | 140/119 |

*Primary Examiner*—Robert L. Spruill

*Attorney, Agent, or Firm*—Townsend & Townsend

[57] ABSTRACT

A wire twister designed for ordinary one-handed use which provides improved positive gripping action to the wire. A rotatable shaft having a wire clenching tip portion is rotatably mounted on a frame. The tip portion includes an open slot for receiving the wire ends, a scored seat region and a spring biased tapered scored plug. A rod attached to the rear of the plug extends lengthwise of the rotatable shaft to the rear of the frame, where it is connected to a thumb operated lever pivotably mounted on the frame for retracting the plug away from the seat region when installing the wire ends. The shaft is rotatable by a conventional transmission mechanism operated by a trigger located forward of a handle portion secured to the frame. The wire clenching tip is relatively small so that the object being secured by the wire is not obscured from view.

5 Claims, 2 Drawing Sheets

WIRE TWISTING APPARATUS

BACKGROUND OF THE INVENTION

This invention relates to wire twisting devices used to twist a folded strand of wire about an object.

Wire twisting devices are known which are used to twist a folded strand of wire about an object to be secured. Such devices have a wide range of applications in such diverse areas as orthodontistry, oral surgery, orthopedic surgery, veterinary surgery and the aircraft industry. In general, the requirement for wire twisting devices in each of these applications is essentially the same: A strand of wire is looped about the object(s) to be secured, the free ends are gripped, and the gripped ends are twisted about one another until the desired amount of twisting is completed. Early wire twister designs employ modified pliers having jaws to grip the wire ends and some means for rotating the pliers about the longitudinal axis. Typically, some type of spiral groove arrangement is employed to provide the rotational motion in known devices.

All known devices suffer from the limitation that two hands are required in order to successfully use the device. One hand is normally used to grip the device, and the other hand is required for a variety of purposes, such as installing the free ends of the wire into the gripping jaws, guiding the wire while it is being twisted or operating various components of the device. This two handed limitation is highly undesirable in most applications. For example, in orthodontistry the orthodontist should ideally have one hand free to use a dental mirror to inspect the effect of the progressive tightening of the wire being twisted on the patient's teeth. In an aircraft industry application, the mechanic should have one hand free in order to stabilize the device being secured. Similar limitations occur in nearly all applications.

In addition to the above noted disadvantage, known wire twisting devices also suffer from the disadvantage that many devices do not adequately grip the wire over the wide range of tension experienced by the wire as it is progressively tightened. In some arrangements, the tension may be initially adequate, but progressive tightening of the wire by twisting causes the free ends of the wire to slip along the gripping surface of the jaws, which is undesirable in many applications.

A further disadvantage with some known wire twisting devices lies in their use of a relatively large gripping head, which obscures the object(s) being secured from the view of the operator, leading to difficulty in operation Efforts to devise a wire twisting apparatus devoid of the above known disadvantages have not been successful to date.

SUMMARY OF THE INVENTION

The invention comprises a wire twisting device which requires only one hand to operate, which provides a positive gripping action to the wire throughout a wide range of wire tension, and which employs a relatively small tip portion so that the operator's view of the workpiece is minimally obscured.

The invention includes a frame member and a shaft rotatably mounted on the frame member, the shaft having a wire receiving tip portion with a tapered wall region forming a seat. A tapered plug means is retractably received within the tip portion in normal contact with the seat. Portions of the surface of the plug means and the wall region are scored or roughened in order to provide a gripping surface for wire received therebetween. The tapers of the wall region and the plug means are substantially identical, and preferably within the range from about 5° to about 30°.

The apparatus is provided with means mounted on the frame member, preferably adjacent a handle portion thereof, for enabling retraction of the tapered plug means during insertion of the wire in the tip portion so that the wire can be received between the plug means and the seat. The retraction enabling means includes biasing means for normally biasing the tapered plug means toward the seat. The invention is further provided with means mounted on the frame member for enabling rotation of the shaft, such as a trigger-like lever.

In the preferred embodiment, the invention includes a one way clutch means mounted on the frame and coupled to the shaft for opposing rotation of the shaft in a selectable direction, i.e., counter clockwise or clockwise, in order to counteract the effect of the tensioned wire on the shaft.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
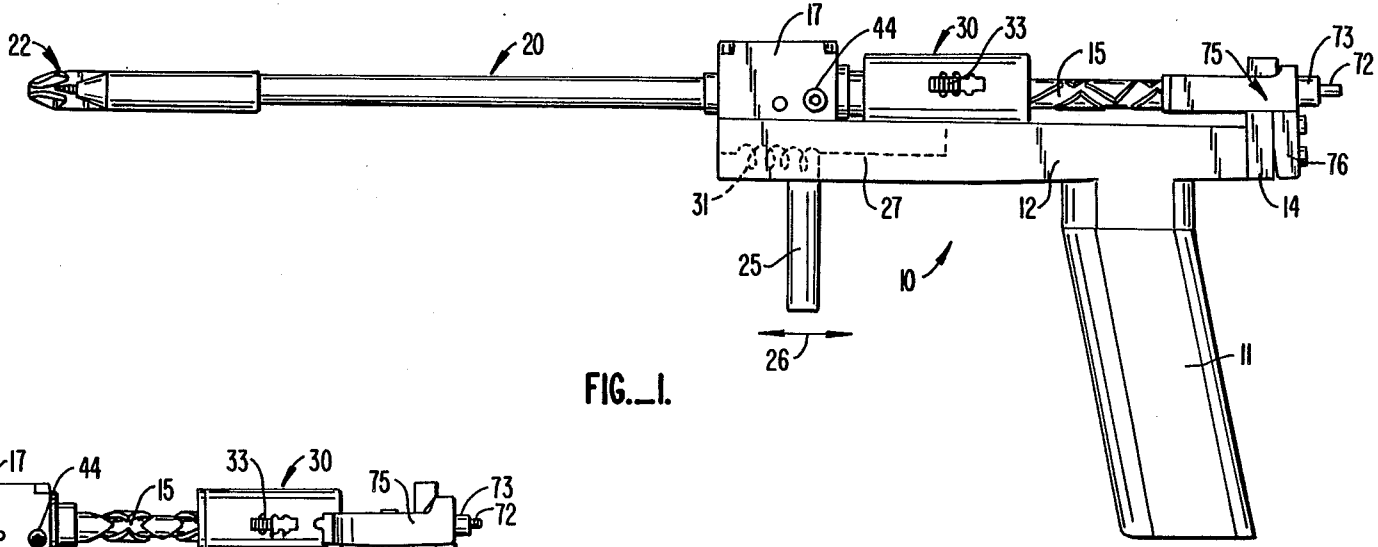
FIG. 1 is a side elevational view of a first embodiment of the invention.

Turning now to the drawings, FIG. 1 illustrates a first embodiment of the invention. As seen in this Fig., a frame member generally designated with reference numeral 10 includes a handle or grip portion 11 secured to the rear of a central body portion 12. Secured to the rear end of central body portion 12 is a journal block 14 for rotatably receiving one end of a helical shaft 15. Helical shaft 15 is rotatably supported at the forward portion thereof in a bearing block 17 mounted on the forward end of central body portion 12. Bearing block 17 also includes a one way clutch mechanism, described below.

Extending forwardly of bearing block 17 is a rotatable shaft generally designated with reference numeral 20. Shaft 20 is mechanically connected to shaft 15 within the bearing block 17. Alternatively, shaft 20 may merely comprise an integral extension of shaft 15.

Positioned at the forward end of shaft 20 is a tip portion 22 for receiving a wire to be twisted in the manner described below.

Figure 2:
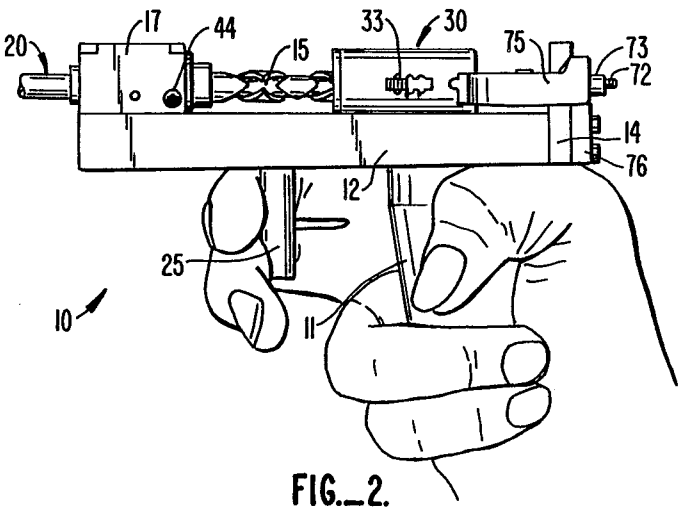
FIG. 2 is a partial side elevational view of the embodiment of FIG. 1 with the trigger fully operated.

Extending downwardly from the central body portion 12 of frame 10 is a trigger like member 25 which is mechanically mounted in any suitable fashion for reciprocable motion along the longitudinal axis of frame member 10, as suggested by double headed arrow 26. Trigger member 25 is mechanically coupled by any suitable means as suggested by broken line 27 to a transmission mechanism 30 of known design. Transmission mechanism 30, for example, may comprise the transmission mechanism from a common hand push screwdriver (e.g., Craftsman No. 31021 sold by Sears Roebuck & Co.). The transmission mechanism 30 functions to rotate shaft 15 in one axial direction when translated from the forward position illustrated in FIG. 1 to the rearward position illustrated in FIG. 2. Preferably, some type of spring bias mechanism is provided to automatically extend trigger member 25 back to the forward direction illustrated in FIG. 1 when the trigger member 25 is released, as suggested by broken line bias element 31. The direction of rotation of shaft 15 when the trigger member 25 is retracted toward the rearward position illustrated in FIG. 2 depends upon the position of settable member 33. U.S. Pat. No. 3,844,322 contains a further description of transmission mechanism 30, and the disclosure of that patent is hereby incorporated by reference.

Figure 3:
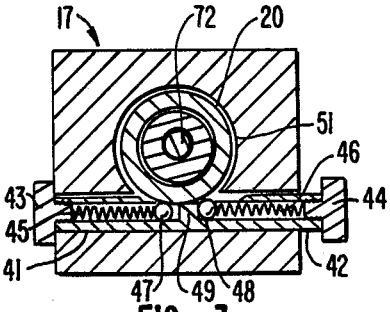
FIG. 3 is a sectional view taken along lines 3—3 of FIG. 1 showing the one way clutch mechanism.

As noted above, secured within bearing block 17 is a three-position reversible one way clutch mechanism for opposing rotation of shaft 20 in a selectable direction. With reference to FIG. 3, a transverse bore 41 is formed in block 17. A tube 42 is slidably arranged in bore 41 and is provided with externally protruding end caps 43, 44 for enabling manipulation of tube 42 along the axis of bore 41. Mounted within tube 42 are a pair of springs 45, 46 and friction balls 47, 48. The central portion of tube 42 is provided with a stop abutment 49. Rotatable shaft 20 is rotatably received within an axially extending bore 51 formed in block 17.

In use, with the tube 42 manipulated to the position illustrated in FIG. 3, rotation of shaft 20 in the clockwise direction is unimpeded. However, if shaft 20 is attempted to be rotated in the counterclockwise direction, the surface friction between ball 47 and the outer surface of shaft 20 inhibits such counterclockwise rotation. Similarly, with tube 42 manipulated to the other extreme position (not illustrated in FIG. 3), counterclockwise rotation is freely permitted, while clockwise rotation is inhibited. Also, with the tube 42 in the intermediate or central portion, shaft 20 is free-wheeling in both directions.

Figure 4:
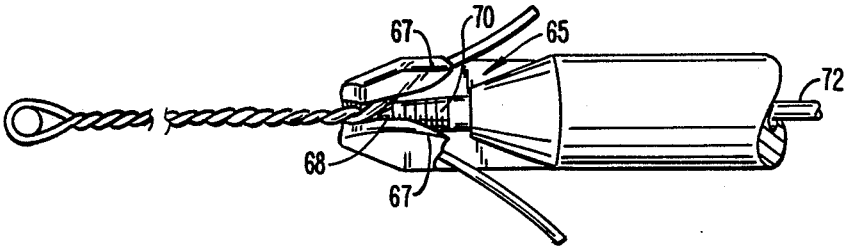
FIGS. 4 and 5 are side and top elevational views of tip portion 22.
Figure 5:
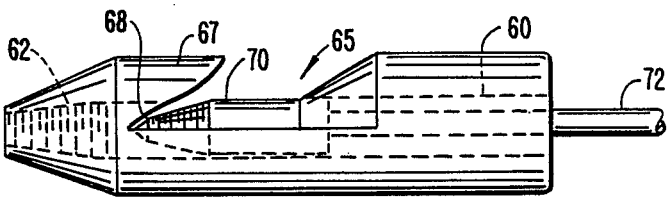

A critical aspect of the invention resides in the tip portion 22 and the associated elements. With reference to FIGS. 4 and 5, tip portion 22 has an axially extending bore 60, a nose portion with a tapered central wall region 62, and a central open slotted region generally designated with reference numeral 65 and having an essentially semi-cylindrical shape which includes a half bore 66 connecting bore 60 with tapered wall region 62. Central region 65 has a pair of relieved shoulder portions 67 providing a notch 68.

Slidably received within bore 60 is a tapered plug 70 having a diameter slightly smaller than the diameter of bore 60. Attached to the rear end of plug 70 is a wire rod 72 which extends the entire length of shaft 20, through bearing block 17 and helical shaft 15, and journal block 14 at the rear of the device (FIG. 1). Secured to the rear end of rod 72 is a stop collar 73 arranged for engagement by a lever mechanism generally designated with reference numeral 75.

Figure 6:
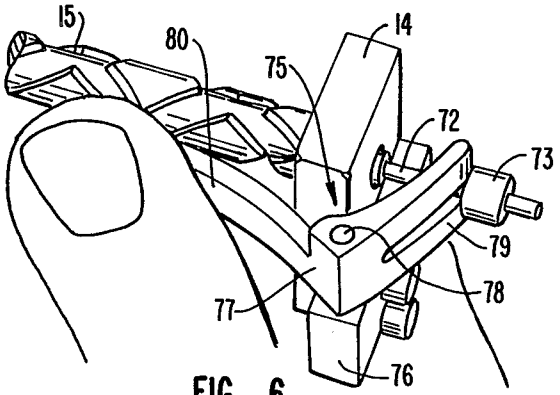
FIG. 6 is an enlarged perspective view of the plug retracting lever mechanism.

As best seen in FIG. 6, lever mechanism 75 includes a mounting block 76 secured to the rear of journal block 14 and providing support for a lever 77 mounted on a pivot post 78. Lever 77 has a first forked end 79 which embraces a portion of wire rod 72 and abuts against stop member 73. The other end of lever 77 comprises a curved portion 80 which can be operated with the thumb of the user in the manner suggested in the Figure.

Figure 7:
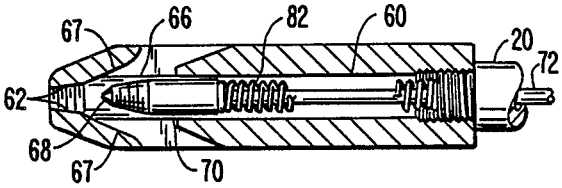
FIG. 7 is a partial view illustrating the plug biasing spring mechanism.

As will now be apparent, when the lever end 80 is pushed inwardly of the frame member 10 by the user's thumb, the lever pivots about pin 78 in such a fashion that the wire rod 72 is withdrawn towards the rear of the device, which retracts the plug 70 from the tip portion 22 of the shaft 20. When the lever is released, the tapered plug 70 is biased forwardly into a seating position with wall 62 by means of bias spring 82 which abuts the rear edge of plug 70 (FIG. 7) and a forward edge of shaft 20. Thus, tapered plug 70 can be completely maneuvered by merely using the thumb.

A significant aspect of the invention lies in the nature of the surface of the tapered plug, the central wall region 62 of tip portion 22 and the surface structure of both the plug 70 and the wall region 62. As best seen in FIGS. 4 and 5, the forward tapered portion of plug 70 is provided with a circumferentially scored or ribbed configuration, which is preferably a saw toothed surface having a groove depth of 0.008 inch and a groove width of 0.015 inch. The wall region 62 is provided with the same surface configuration, and the taper angles of both plug 70 and the wall region 62 are essentially identical. The preferred taper is about 10°: However, a wider range of taper angles can be employed, depending on the size, stiffness, and hardness of the wire to be twisted. As a practical matter, the range extends from around 5° to about 30°. It has been found that, without this textured surface, the wire cannot be adequately grasped between the tapered plug 70 and the seat surface 62 and will tend to slip out as the wire is tightened.

Regarding the taper angle, if the angle is too steep, the wire will not be firmly grapsed by the device unless an excessive force is exerted by the plug 70 against the wall region 62. If the angle is too shallow, then the wire has a tendency to permanently lock in the tip due to locking of the plug within the wall region 62. Both of these conditions tend to reduce the utility of the device as a one handed tool, and are thus best avoided.

The diameter of the plug 70 as noted above is slightly smaller than the diameter of bore 60. This allows the plug 70 to self-align into the tip portion thus enabling the tapered, scored or notched surfaces to grip both ends of the wire in an equal fashion.

In use, the wire to be twisted is looped around the object to be secured and the ends are placed in the tip region 22 by simply maneuvering the wire into the slotted region 65. This can be accomplished in most cases by simply maneuvering the device with one hand and "snagging" the wire ends into the tip. To secure the wire ends into the tip 22, the lever mechanism 75 is operated to retract the tapered plug 70 away from the seat region 62 so that the wire ends can be interposed between these two elements, and this is followed by release of the lever mechanism 75 so that plug 70 forces the wire ends against wall seat region 62 under the force of light spring 82. Thereafter, trigger member 25 is repeatedly operated which rotates shaft 20 and results in the twisting of the wire to the desired extent. Once the wire has been completely twisted, it can be released from the device by simply operating lever mechanism 75 to retract plug 70.

The wire gripping function of the invention has been found to be essentially self-locking. More particularly, once the wire has become wedged between the surface of the tapered plug 70 and the seat region 62 further longitudinal force exerted by pulling the tip region 22 away from the object causes the wire to engage the seat region 62 more firmly and to drag the tapered plug 70 along. Also, the spring 82 urges plug 70 in the locking direction. Consequently, the harder the operator pulls on the tip region 22, the more firmly the wire is gripped, which eliminates any slipping of the wire in the device during twisting.

Figure 8:
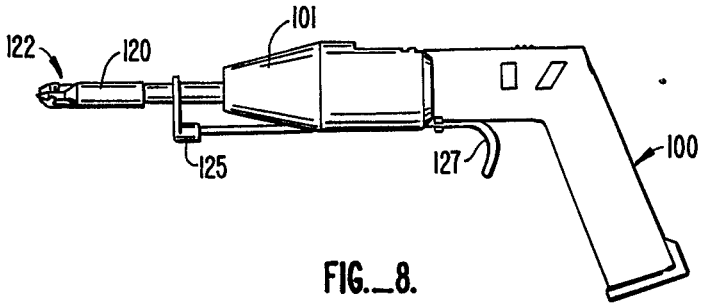
FIG. 8 is a side elevational view of an alternate embodiment of the invention.

FIG. 8 illustrates an alternate embodiment of the invention which is adapted to be releasably attached to a conventional battery operated screwdriver or drill 100. As seen in this Fig., a housing 101 configured to be mechanically conformable with the driving end of power tool 100 includes a rotatable shaft 120 having a tip portion 122. Shaft 120 is mechanically linked in a conventional manner to the drive shaft of tool 100 when the housing 101 is attached to the tool 100. A lever mechanism is provided for retracting the plug 70 from the tip portion 122 and includes a translatable yoke 125 engageable with a pin secured to the retractable wire rod 72 (not illustrated) and mechanically operated by a pull rod 127.

As will now be apparent, a wire twisting apparatus fabricated according to the teachings of the invention affords a number of advantages over known devices. Perhaps the most significant advantage is the fact that the device can be operated entirely with one hand in most applications to both snag the wire and perform the twisting. In addition, the scored tapered plug and seat afford secure gripping of the wire throughout the twisting operation without requiring a significant amount of force to be exerted by the plug 70 on the wire against the seat 62. In addition, the one way clutch mechanism reduces the tendency of the wire to partially untwist during the twisting operation due to the developing tension in the wire. Further the relatively small dimensions of tip region 22 affords a broad viewing angle of the workpiece to the operator.

While the above provides a full and complete disclosure of the invention, various modifications, alternate constructions and equivalents will occur to those skilled in the art. For example, the transmission mechanism 30 is illustrative only, and other mechanisms, such as a known ball bearing screw can be employed, as desired. Also, although tapered plug 70 has been described as having circular geometry, other shapes may be employed. For example, plug 70 may comprise a tapered member with a square or rectangular axial cross-section, if desired. Therefore, the above should not be construed as limiting the invention, which is defined by the appended claims.

What is claimed is:

1. A wire twisting apparatus capable of one-handed operation, said apparatus comprising:

a frame member having a handle adapted to be grasped by a hand of a user;

a shaft rotatably mounted on said frame member, said shaft having a wire receiving apertured tip portion, said apertured tip portion having an axial bore with a tapered wall region forming a seat, said tip portion having an axially extending open slot intersecting the aperture in the tip portion and extending longitudinally therefrom for a distance along said tip portion and of a depth which intersects the bore in the tip portion for enabling a pair of wire ends to be positioned between said plug means and said seat without requiring insertion through said apertured tip portion;

tapered plug means retractably received in said tip portion in the bore of normal contact with said seat, the tapers of said wall region and said plug means being substantially identical, said wall region and said plug means each having a taper angle lying in the range from about 5° to about 30°;

means mounted on said frame member for enabling retraction of said tapered plug means so that a pair of wire ends can be received between said plug means and said seat via said slot, said retraction enabling means including lever means coupled to said plug means and movably mounted on said frame member adjacent said handle portion so that said plug means can be manually retracted by the same hand grasping the handle, said retraction enabling means further including means for normally biasing said plug member toward said seat;

means mounted on said frame member for enabling rotation of said shaft; and means for locking a pair of wire ends received between said plug means and said seat, said locking means including a roughened portion of said plug means and a roughened portion of said seat, each roughened portion having a ridged surface with peripherally extending contour lines.

2. The invention of claim 1 wherein said roughened surface has a saw toothed shape.

3. The invention of claim 1 wherein said apparatus further includes one-way clutch means mounted on said frame and coupled to said shaft for opposing rotation of said shaft in a preselected direction.

4. The invention of claim 3 wherein said clutch means includes means for selecting the preselected direction.

5. The invention of claim 1 wherein said apparatus is detachably mounted to a power source for rotating said shaft.

* * * * *